US005516058A

United States Patent [19]

Omokawa et al.

[11] Patent Number: 5,516,058

[45] Date of Patent: May 14, 1996

[54] METHOD AND APPARATUS FOR TAKING UP NARROW SHEET MEMBER

[75] Inventors: Toshihiko Omokawa; Kenji Mishima, both of Shirakawa, Japan

[73] Assignee: Sumitomo Rubber Industries Limited, Hyogo, Japan

[21] Appl. No.: 323,661

[22] Filed: Oct. 17, 1994

[30] Foreign Application Priority Data

Oct. 21, 1993 [JP] Japan ..... 5-263836

[51] Int. Cl.[6] ..... B65H 23/198; B65H 23/192; B65H 18/10

[52] U.S. Cl. ..... 242/413.6; 242/418; 242/471; 242/530

[58] Field of Search ..... 242/471, 530, 242/530.4, 530.2, 413.6, 418, 418.1, 419.8, 419.9, 530.1, 530.3

[56] References Cited

U.S. PATENT DOCUMENTS

| | | | |
|---|---|---|---|
| 1,977,197 | 10/1934 | Neus . | |
| 3,921,929 | 11/1975 | Jores et al. | 242/530 X |
| 4,293,101 | 10/1981 | Dunaevsky et al. . | |
| 4,431,142 | 2/1984 | Kataoka | 242/418 X |
| 4,447,016 | 5/1984 | Enberg et al. . | |
| 4,629,139 | 12/1986 | Sanda et al. | 242/530.4 X |
| 4,759,512 | 7/1988 | Gaiser | 242/471 |
| 5,062,582 | 11/1991 | Harmon | 242/530.2 X |
| 5,169,083 | 12/1992 | Sannohe et al. | 242/471 |
| 5,178,341 | 1/1993 | Ditto . | |

FOREIGN PATENT DOCUMENTS

| | | | |
|---|---|---|---|
| 1226830 | 8/1960 | France . | |
| 1245786 | 10/1960 | France . | |
| 2054738 | 5/1971 | France . | |
| 3414636 | 11/1984 | Germany | 242/530.4 |
| 60-262766 | 12/1985 | Japan . | |
| 1-316253 | 12/1989 | Japan . | |

*Primary Examiner*—John M. Jillions

[57] ABSTRACT

A method and apparatus for taking up a narrow sheet member which is a tire component in which disordered winding by detecting a difference between a delivery velocity and a takeup velocity of the narrow sheet member using a dancer member, and by controlling a drive motor of a bobbin using the detected signal in such a way that the takeup velocity and the delivery velocity are equal to each other.

6 Claims, 3 Drawing Sheets

V1
V
8
9
10
11
12
14
15
16
17
18A
18B
22

METHOD AND APPARATUS FOR TAKING UP NARROW SHEET MEMBER

FIELD OF THE INVENTION AND RELATED STATEMENT

This invention relates to a method and apparatus for taking up a narrow sheet member which is utilized for the manufacture of a tire component such as a thread-containing rubber sheet or a nylon strap.

Japanese Unexamined Patent Publication Hei 5(1993)-8321 is known as a technique for rewinding a sheet member such as a chord-containing rubber sheet which has previously been prepared in a wide form, splitting the sheet into several narrow sheets, delivering the narrow sheets in the longitudinal direction thereof, and winding the sheet members around a bobbin one by one.

OBJECT AND SUMMARY OF THE INVENTION

The prior art disclosed in the foregoing patent publication is effective to a certain extent, but it might lead to variations in winding tension with respect to a bobbin, and hence disordered winding, when a difference between a delivery velocity and a takeup velocity of the narrow sheet members is caused by variations in a takeup diameter or the like.

Hence, the object of the present invention is to provide a takeup method and apparatus which can prevent disordered winding and enables the even takeup of narrow sheet members while the adhesion of the sheet members, coiled around a bobbin, with each other is prevented.

According to this invention, there is provided a takeup method including the steps of splitting a wide sheet member into several narrow sheet members, delivering the narrow sheet members in the longitudinal direction thereof, and spirally winding the narrow sheet members around bobbins one by one, the improvement being characterized by comprising the steps of:

detecting a difference between a delivery velocity and a takeup velocity of the narrow sheet member by means of a dancer member provided in the course of delivery of the narrow sheet members; and controlling a drive motor of a bobbin in such a way that the takeup velocity equals the delivery velocity using the detected signal.

According to this invention, there is provided a narrow sheet member takeup apparatus in which a wide sheet member is split into a number of narrow sheet members, and the narrow sheet members thus split are delivered in the longitudinal direction thereof, and the narrow sheet members are coiled around bobbins one by one, the improvement being characterized by comprising:

dancer members provided in the course of delivery of narrow sheet members for detecting a difference between a delivery velocity and a takeup velocity of the narrow sheet members;

drive motors which drive bobbins by controlling in such a way that the takeup velocity equals the delivery velocity using the detected signal; and guide members which travel back and forth in the axial direction of the bobbins and shift the position of the narrow sheet members. The wide sheet member, consisting of a ply master roll such as a chord-containing rubber sheet coiled in the form of a roll, is rewound. This wide sheet member is then delivered to bobbins of a takeup apparatus in the longitudinal direction of the sheet member by means of a delivery means.

During the course of delivery of the wide sheet member, it is split into several narrow sheet members by a slitting means and a splitting means. The narrow sheet members thus split are spirally coiled around the bobbins, respectively.

When there arises a difference between the delivery velocity and the takeup velocity of the narrow sheet members, the dancer members carry out dancer operations, and a switching means detects the velocity difference. The narrow sheet members are taken up by controlling the drive motors in such a way that the takeup velocity equals the delivery velocity using this detected signal. The guide members travel back and forth in the axial direction of the bobbins, whereby the narrow sheet members are spirally taken up with a constant tension.

BRIEF DESCRIPTION OF THE DRAWING

In the accompanying drawings:

FIGS. 2*a* through 2*c* are explanatory views illustrating the operation of the takeup apparatus, wherein FIG. 2*a* shows the operation when a delivery velocity and a takeup velocity are equal to each other, FIG. 2*b* shows the operation when the delivery velocity is accelerated faster than the takeup velocity, and FIG. 2*c* shows the operation when the delivery velocity is decelerated slower than the takeup velocity.

DETAILED DESCRIPTION OF THE PREFERRED EMBODIMENTS

Figure 1:
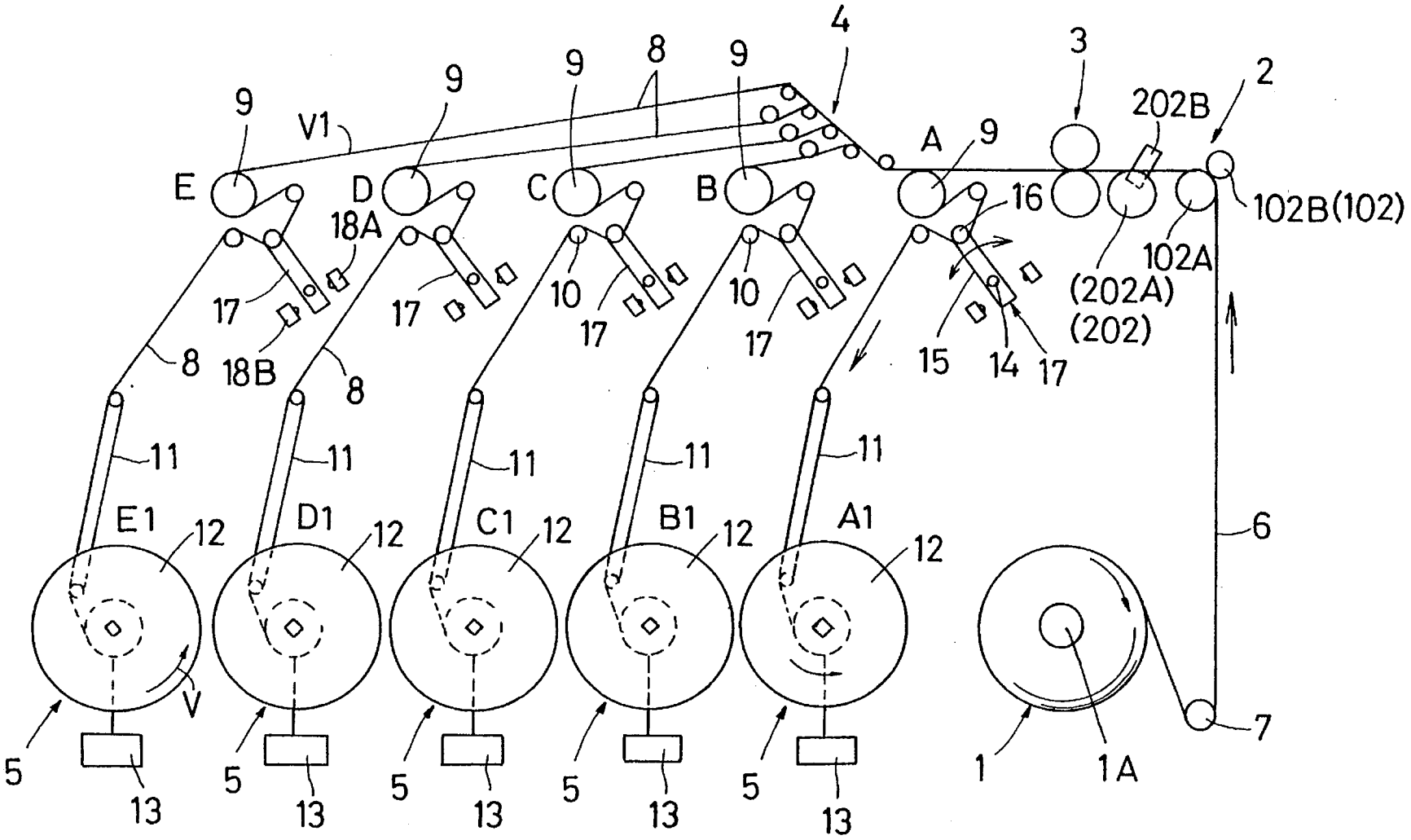
FIG. 1 is an elevation view of the entire construction showing a preferred embodiment of a narrow sheet member takeup apparatus according to this invention.

FIG. 1 shows the entire construction of a narrow sheet member takeup apparatus, and the apparatus is provided with a rewinding unit 1, a slitting means 2, a delivery means 3, a splitting means 4 and a takeup unit 5.

The rewinding unit 1 is designed to rewind a wide sheet member 6, which is a ply master roll such as a chord-containing rubber, while the sheet member is being wound like a roll around a spool 1A with an air brake. The rewound wide sheet member 6 is delivered to the delivery means 3 by way of the slitting means 2 disposed in the course of delivery of the wide sheet member 6 through a guide roll 7.

In the embodiment, the slitting means 2 is provided with a score cutter 102 and a leather cutter 202 which is disposed after the score cutter in the delivery direction. The score cutter 102 deeply cuts into the wide sheet member 6 by pressing a round cutter 102B against a smooth roll 102A, and the leather cutter 202 is designed to split the sheet member 6 by inserting a thin blade 202B into a grooved roll 202A.

The delivery means 3 represented in the shape of a roll is disposed downstream from the slitting means 2. The splitting means 4 consisting of a group of rolls is provided downstream from the delivery means 3. The wide sheet member 6 is split into several pieces, in this embodiment five sheets 8, by the splitting means 4 and the slitting means 2. These sheets 8 are delivered to five bobbins 12 of takeup apparatuses 5 via tension rollers 9, guide rollers 10 and guide members 11. Each narrow sheet member 8 is spirally wound around each bobbin 12.

The tension rollers 9 are marked A–E in the order of the length of delivery from, shorter to longer. These tension rollers 9 are designed to prevent a splitting failure after the narrow sheet members 8 have been split and slack of the sheet by gradually increasing peripheral velocities of the tension rollers 9 so that the roller 9E moves faster than the roller 9A.

The takeup apparatuses 5 are also marked A1–E1 corresponding to the tension rollers 9. Any one of the takeup apparatuses 5 is provided with the flanged bobbin 12 which is rotated around the horizontal axis by the drive motor 13, and each apparatus 5 is also provided with a guide member 11 that reciprocates in the axial direction of the bobbin 12 and also pivotally moves.

Dancer members 17 that vertically pivots on fulcrums 14 are provided near the guide rollers 10 in the course of the delivery of the sheet 8 between the tension rollers 9 and the guide members 11. In the dancer member 17, a roller 16 is disposed at the end of an arm 15, and the roller 16 is brought into contact with the narrow sheet member 8, so that it becomes possible for the roller 16 to perform a dancer movement. Thereby, a difference between a takeup velocity V and a delivery velocity V1 is detected.

Figures 2A, 2B, 2C:
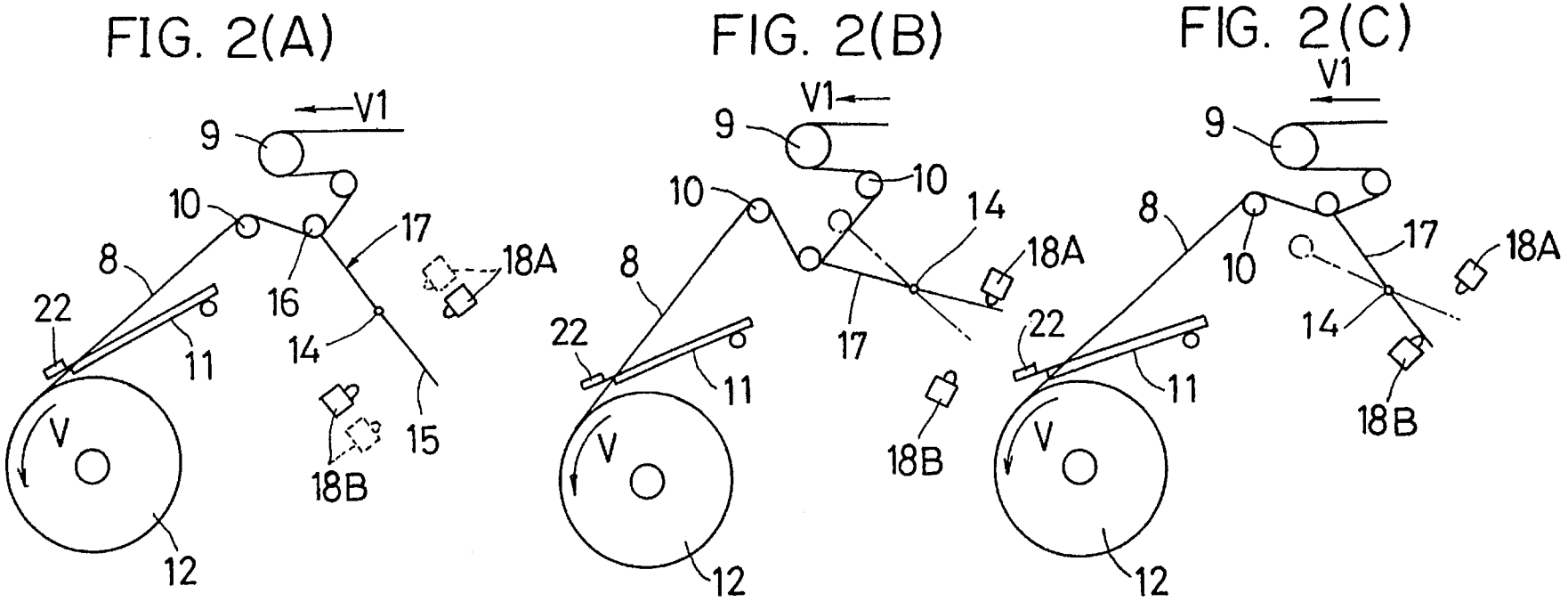

In other words, as shown in FIG. 2A, when the takeup velocity V and the delivery velocity V1 are equal to each other, the dancer member 17 is positioned at a neutral location. However, when V<V1 occurs because of variations in a takeup diameter, the dancer member 17 pivots downwardly under its own weight as shown in FIG. 2B. This downward pivotal movement is detected by an adjacent switch such as a detector 18A which serves as a switching means. On the basis of this detected signal, the drive motor 13 is controlled to accelerate so that V=V1. On the other hand, when V>V1, the dancer member 17 pivots upwardly as shown in FIG. 2C. This upward pivotal movement is detected by a detector 18B which serves as a switching means, and the drive motor 13 is controlled to decelerate so that V=V1.

The narrow sheet member 8 is directly coiled around the bobbin 12 in a spiral manner, the diameter of the bobbin 12 is set to more than 100 mm. This is intended to prevent the sheet member from being susceptible to remaining in a coiled shape when the narrow sheet member is directly coiled if the diameter is less than 100 mm.

Figure 3C:
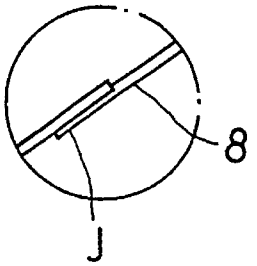
FIG. 3*c* is an enlarged view of the joint structure of the sheet members.
Figure 3B:
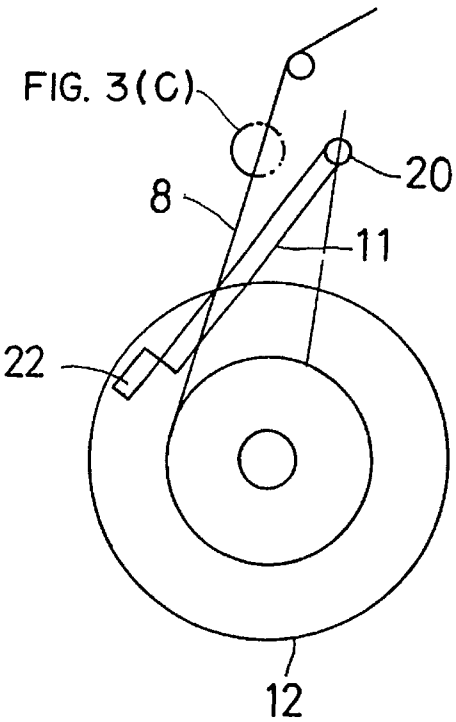
FIGS. 3*a* and 3*b* are respectively a front view and a side elevation view, each showing a relationship between a guide member and a bobbin
Figure 3A:
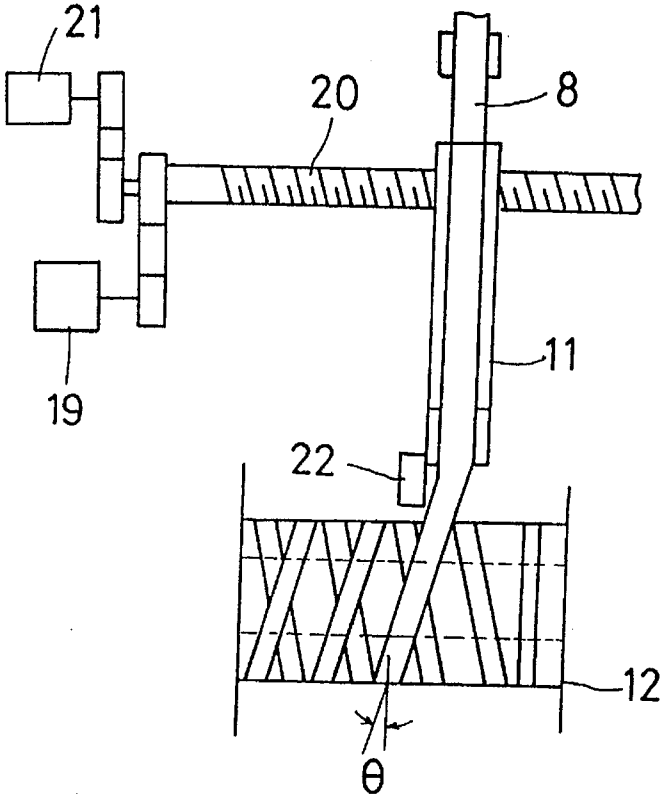

In the guide member 11, as shown in FIGS. 3A and 3B, the base of the guide member 11 is fitted around a screw shaft 20, which is provided so as to be reversely movable by means of the motor and a reverse clutch 19, in such a way that it is screwed to reciprocate in the direction parallel to the axial direction of the bobbin. The end of the guide member 11 is movable so as to be close to and far away from the outer peripheral surface of the bobbin 12 by means of an oscillating rotary driving body 21, and hence the guide member 11 follows the diameter of the coiled sheet. For this reason, a detector 22 such as a photoelectric switch is provided at the end of the guide member 11, and the oscillating rotary driving body 21 is designed to actuate by this detected signal.

As shown in FIG. 2A, when the narrow sheet member 8 is directly coiled around the bobbin 12 in a spiral manner by causing the guide member 11 to travel parallel to the axial direction of the bobbin, a wrapping angle θ is set in the range from 0.02° to 5°, more preferably, in the range from 0.04° –1.5°.

When the sheet is directly coiled around the bobbin in a spiral manner at a wrapping angle of less than 0.02°, the amount of overlap between the narrow sheet members 8 increases. In this case, the sheet members 8 adhere too closely to each other because of their stickiness. However, when the wrapping angle exceeds 5°, a torsional force which acts on the narrow sheet member 8 becomes larger, and in some cases a kink occurs at a turnover point of the sheet member 8.

Moreover, when the narrow sheet members 8 need to be joined to each other, it is desirable for the sheet members 8 to be connected in the form of a joint structure J shown in FIG. 3B and FIG. 3C.

This is because it is possible to prevent the sheet members 8 from being disconnected from each other or becoming loose by pulling up the joint structure J when the sheet members 8 are rewound from the bobbin 12.

Means other than that shown in the drawings may be used as the slitting means 2, and the score cutter and the leather cutter may be positioned in reverse order. Alternatively, either one of the score cutter and the leather cutter may be sufficient. As shown by a dotted line in FIG. 2A, each of the detectors 18A and 18B, serving as a switching means, may be constituted by a pair of detectors, and hence they may consist of four detectors in total. Instead of these adjacent switches, an angle may be detected by an encoder.

As mentioned above, according to the present invention, it is possible to take up a narrow sheet member evenly and orderly retaining its shape without the use of a liner, while the rewinding of the sheet member is kept simple.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. A narrow sheet member takeup method comprising the steps of:

splitting a wide sheet member into a number of narrow sheet members;

delivering the split narrow sheet members in the longitudinal direction thereof;

spirally winding the narrow sheet members around bobbins, respectively;

detecting a difference between a delivery velocity and a takeup velocity of the narrow sheet members by means of dancer members provided in the course of delivery of the narrow sheet members;

controlling drive motors of the bobbins in such a way that the takeup velocity equals the delivery velocity using the detected signal; and preventing slack of the narrow sheet members with use of tension rollers which pull and deliver the narrow sheet members and are provided in the course of the delivery of the narrow sheet members upstream from the dancer members by gradually increasing peripheral velocities of the tension rollers so that the tension rollers having a longer distance of delivery of the narrow sheet member gradually move faster than the tension rollers having a shorter distance of delivery of the narrow sheet member.

2. A narrow sheet member takeup method according to claim 1, wherein the angle for spirally winding the narrow sheet member around the bobbin is set to the range between 0.02 to 5 degrees.

3. A narrow sheet member takeup method according to claim 1, wherein the bobbin around which the narrow sheet member is spirally wound has a diameter more than 100 mm.

4. A narrow sheet member takeup apparatus in which a wide sheet member is split into a number of narrow sheet members, and the narrow sheet members thus split are delivered in the longitudinal direction thereof, and the narrow sheet members are coiled around bobbins one by one; the takeup apparatus comprising:

dancer members provided in the course of travel of the narrow sheet members for detecting a difference between a delivery velocity and a takeup velocity of the narrow sheet members;

drive motors which drive the bobbins by controlling in such a way that the takeup velocity equals the delivery velocity using the detected signal;

guide members which travel back and forth in the axial direction of the bobbins and shift the position of the narrow sheet members; and tension rollers which pull and deliver the narrow sheet members and are provided in the course of the delivery of the narrow sheet members upstream from the dancer members, peripheral velocities of the tension rollers being gradually increased so that the tension rollers having a longer distance of delivery of the narrow sheet member gradually move faster than the tension rollers having a shorter distance of delivery of the narrow sheet member.

5. A narrow sheet member takeup apparatus according to claim 4, wherein the dancer members have rollers that are disposed on the end of arms, which vertically pivot on fulcrums, and come into contact with the narrow sheet members.

6. A narrow sheet member takeup apparatus according to claim 4, wherein the dancer members have rollers that are disposed on the end of arms, which vertically pivot on fulcrums, and come into contact with the narrow sheet members.

* * * * *